United States Patent [19]

Allard

[11] 4,317,328

[45] Mar. 2, 1982

[54] COMBINATION OF STRAND NEUTRALIZER CAPSTAN AND ACCUMULATOR AND CLOSER

[75] Inventor: Joseph R. Allard, Warwick, R.I.

[73] Assignee: The Entwistle Company, Hudson, Mass.

[21] Appl. No.: 222,369

[22] Filed: Jan. 5, 1981

[51] Int. Cl.[3] ..... D07B 3/00; D07B 3/02

[52] U.S. Cl. ..... 57/59; 57/58.84

[58] Field of Search ..... 57/58.84, 58.70, 59, 57/60, 62, 264, 294, 314, 58.86, 58.83, 17, 18, 115; 242/128

[56] References Cited

U.S. PATENT DOCUMENTS

| | | | |
|---|---|---|---|
| 3,338,541 | 6/1968 | Biagini . | |
| 3,396,522 | 8/1968 | Biagini . | |
| 3,481,127 | 12/1969 | Vogelsberg . | |
| 3,490,222 | 1/1970 | Allard | 57/59 |
| 3,507,108 | 4/1970 | Yoshimura . | |
| 3,643,411 | 2/1972 | Vogelsberg . | |
| 4,087,956 | 5/1978 | Gre | 57/58.86 X |
| 4,100,721 | 7/1978 | Selichi . | |

*Primary Examiner*—Donald Watkins
*Attorney, Agent, or Firm*—Barlow & Barlow

[57] ABSTRACT

A continuous process of drawing a plurality of strands from a supply and neuturalizing the twist as taken from supply reels, twisting the various strands into a cable and then passing the cable over capstans and an accumulator to maintain proper tension in the cable and then on to a closer where the cable is packaged, all units being driven from a common shaft in time with each other and in a one-to-one relationship with the elimination of back twist in individual strands and the maintenance of uniform tension on the individual strands and a minimum tension on the cable.

3 Claims, 2 Drawing Figures

COMBINATION OF STRAND NEUTRALIZER CAPSTAN AND ACCUMULATOR AND CLOSER

RELATED APPLICATIONS

The strand supply and neutralizer is set forth in some detail by itself in Joseph R. Allard patent application Ser. No. 137,978 filed Apr. 7, 1980. The capstan and accumulator with tension control is set forth in detail in patent application filed in the name of Joseph R. Allard, Ser. No. 178,289, Aug. 15, 1980.

BACKGROUND OF THE INVENTION

In the formation of a cable from several strands of wire or fibre optic material, the strands have heretofore been taken from a plurality of supplies and usually these supplies are in a rigid strander or closer without pay-off neutralizers. With this system, back twist in the strands will occur as they are brought into twist relation in the cable. If the strands have any back twist, the cable will be distorted and in some cases where the strands are small in diameter, such as in optic fibre cable, breaking is frequent. Usually also the individual units, such as the supply, are not driven and it is difficult to maintain a balanced relation between the strands as twisted and the back twist which occurs in the strands as they are drawn from the supplies. Further, the closer is also a substantially individual unit which may be driven at a different speed than the other units and some compensation must be provided.

SUMMARY OF THE INVENTION

The invention in this application is designed to combine the various units above mentioned of supply and neutralizer, the capstan and accumulator, and the closer by arranging them in generally tandem relation and driving them all from a common shaft extending the length of all of the tandem units controlling the speed of the different units electrically so as to keep them in the desired timed relation.

PREFERRED EMBODIMENT OF THE INVENTION

Figure 1:
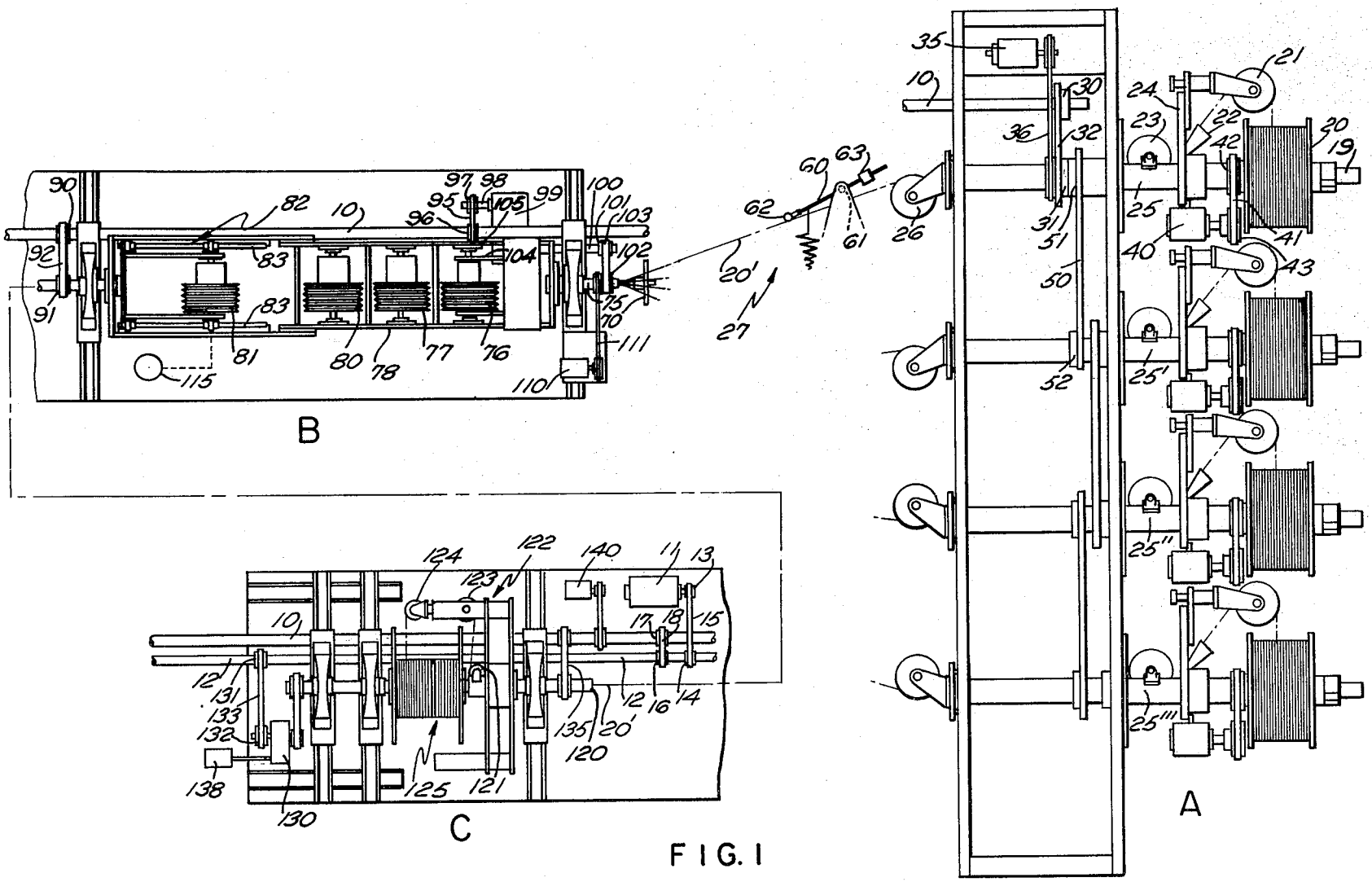
FIG. 1 is a largely diagramatic view illustrating the various units mentioned and in greater detail the closer for the cable, also incorporating the electrical controls for the various units in the desired timed relation.

With reference to FIG. 1 of the drawings in which the supply and neutralizer unit is designated as Unit A, the capstan and accumulator unit is designated Unit B, and the closer is designated as Unit C, a common drive shaft 10 extends the length of all three units, although it is shown in separate parts because of its length, and drives each of the units. The motor designated 11 in Unit C is coupled to a jack shaft 12 through pulleys 13, 14 and belt 15, and from this jack shaft, provides power to the line shaft 10 by pulleys 16, 17 and belt 18.

Figure 2:
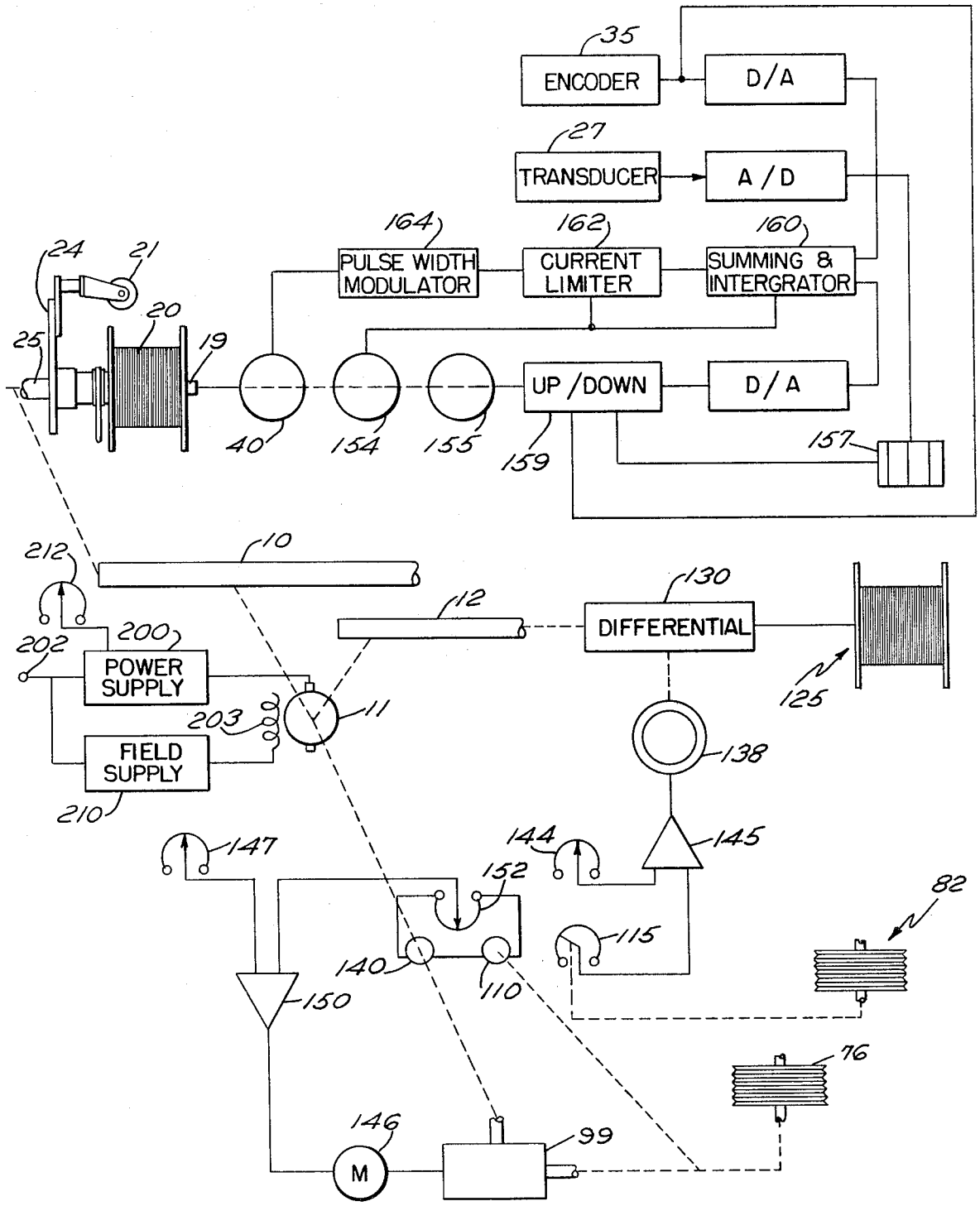
FIG. 2 is an electrical block diagram of the control for the invention.

The strand supply Unit A has a plurality of supply spools 20 mounted on shaft 19, each of identical construction and each, as more fully pointed out in my application Ser. No. 137,978, furnishes a wire or fibre optic strand over guide pulley 21 and through the guide tube 22 beneath pulley 23, both guide tube and pulley being mounted on flyer 24, and thence through drive shaft 25 and over pulley 26 to a tension transducer designated generally 27 and thence to the capstan and accumulator Unit B. Shaft 25, 25', 25'' and 25''' are driven from shaft 10 through pulleys 30 and 31 and belt 32 while an encoder 35 is driven from shaft 10 by belt 36. An encoder 155 (not shown, see FIG. 2) that monitors the pay-off, is mounted on each flyer 24 and for example, is driven by belt 41 from shaft 19 by pulleys 42, 43.

As mentioned above, each of these individual strand supply furnishes one strand for the cable which is twisted with other strands to form the cable. Each of these units or reels 20 is mounted on a cantilevered shaft 19 that rotates within shaft 25 and strand wire is drawn from the reels over pulley 21, and this pulley is mounted on the flyer 24 which rotates while the axis of the spool remains stationery, although the spool may turn on this axis as the wire is drawn therefrom. When a wound wire around the spool is drawn without turning the spool as a whole, a back twist would be placed in the wire or strand. However, by passing the wire over the flyer which rotates one rotation relative to the spool, this back twist would be taken out of the strand. Other units of this sort for other individual strand supplies are shown in A of the drawing and these are all driven also from one another, all being driven from the shaft 10, thus another unit is driven by belt 50 through pulley 51 on shaft 25 and pulley 52 on shaft 25' and also for the other units having shafts. Shaft 25'' is driven from shaft 25' and shaft 25''' is driven from shaft 25'' in a similar manner.

After each strand emerges from the pulley 26 it passes to the tension transducer 27 and before it enters the capstan unit, it passes through this tension transducer unit, which is shown schematically and which comprises a rod 60 pivoted as at 61 and provided with a pulley 62 to engage the strand 20'. This lever is weighted as at 63 and will move up and down according to the tension of the strand 20', all of which will control the tension of the strand (as will presently be described) as it passes to the lay plate 70 through which the other strands from the other supplies also pass. These strands then pass into the capstan and accumulator designated generally B in the drawing, which unit operates as more fully disclosed in my application Ser. No. 178,289.

The general arrangement of this capstan and accumulator designated B is that from the lay plate 70 the strands enter the machine and are twisted. These strands pass into a hollow shaft 75 and to a pair of capstans 76 and 77 mounted in a generally rectangular frame 78. The capstans have sheaves each having a plurality of grooves to receive the individual strands where they are twisted into a cable. The cable enters the groove in capstan 76 which is on the axial center of the frame in which the capstans are mounted, and then passes to the groove on the axial center of the second capstan 77 of the frame, thence returning to the next groove and capstan 76 and an aligned groove in capstan 77 and so forth about the plurality of grooves and then passes to an outer groove in pulley 80 which is one of the two accumulator pulleys 80 and 81, also mounted in this rectangular frame. The pulleys 80 are individual pulleys loosely mounted upon a shaft fixed in the frame. As for the pulleys 81, they are also individual pulleys loosely mounted on a shaft but this shaft is mounted in a carriage 82 which is slidably mounted on rods 83 in the frame. The cable passes from the pulleys 80 to the pulleys 81 back and forth in a manner similar to the cable passing about the capstans 76 and 77 and emerges on the center line or axial line of the rectangular frame and thence out of the frame. The moveable accumulator pulley 81 in its carriage will slide either toward the entrance of the cabler or away from the entrance of the cabler, depending on the tension of the cable, and the position of the pulley 81 carriage is monitored by potentiometer 115.

In the Unit B the frame in which the capstans and accumulator are mounted is rotated from the main drive shaft 10 through pulleys 90 on shaft 10 and pulley 91 on the shaft fixed to one end of the frame 78 through belt 92. However, the rotation of the capstans is accomplished from shaft 10 by a belt drive 96 trained over pulleys 96, 97 to input shaft 98 of a variable speed mechanism 99 which has an output shaft 100 extending therefrom. The drive train continues via pulley 101 on shaft 100 and pulley 102 on a hollow shaft 75 at the other end of the frame containing the capstans, through belt 103 which serves to drive the capstans by means of bevel gears extending laterally of the frame and belt 104 on pulley 105 of the first capstan 76. The cable drives the other capstans and accumulator as it is pulled through the machine. A tachometer generator 110 is also driven from the shaft 75 by belt 111 which in effect monitors the line speed of the wire or cable.

As mentioned before, the accumulator carriage 83 is mechanically coupled to a potentiometer 115 and the electrical position of this potentiometer is then sent on through suitable electronic controls to vary the speed of the take-up reel on which the cable product is wound. In effect the position of the accumulator sheave 81 will control the tension of the cable line and, as will be presently described, effectively signals the take-up reel 125 to either speed up or slow down so that the tension will be maintained constantly. Tension on the cable product is initially insured by a torque motor or pneumatic means connected to the accumulator 81.

The take-up mechanism designated generally C, receives the cable 20' from the capstan and accumulator frame into and through shaft 120 which passes then about pulley 121 to a rotatable flyer frame designated generally 122 out about guide pulley 124 to the take-up reel 125 which is moved axially to distribute the cable thereon. This take-up reel 125 is driven by a variable differential 130 from jack shaft 12 through pulleys 131, 132 and belt 133 and is controlled by a servo 138 to vary the speed of the reel take-up. The flyer 122 is coupled to line shaft 10 by belt 135.

As has been noted above, the cabling apparatus basically comprises a multiple end supply and neutralizer, a capstan and accumulator, a closer take-up reel. There extends from the closer and take-up reel to the rotating capstan and accumulator, thence to the neutralizer a timing shaft 10. This timing shaft 10 is coupled to each unit and operates effectively in such a way that when the rotor 122 makes one revolution, the capstan frame 78 rotates one turn and the flyer 24 for each of the strands rotates one turn. The drive system essentially is diagrammed at FIG. 2 in a simplified electrical diagram where a power supply 200 receives its energization from an alternating current source 202. The output of the power supply is directed to a main drive direct current motor 11 which has a field voltage supplied by a field supply 210 from the same alternating current source 202. To control the speed of the device, a speed control potentiometer 212 may be used. The motor 11 is mechanically coupled to a jack shaft 12 in Unit C and is also mechanically coupled to the timing shaft 10. The jack shaft 12 is also mechanically coupled to a differential 130 whose output is mechanically coupled to the reel 125, and a servo 138 is also coupled to the differential to control the speed of the reel 125. In essence, the reel 125 will rotate sufficiently to take up the product as it comes from the accumulator 82 and the speed of the reel 125 is effectively controlled by the position of the accumulator 82, which is coupled to a potentiometer 115. Another variable potentiometer 144 is used as a balancing device to effectively position the accumulator in a normal central position, and the potentiometers 115 and 144 feed a differential amplifier 145, the output of which will signal the servo 138. In effect, the position of the accumulator 82 will control the tension of the cable line, and effectively it tells the take-up reel 125 to either speed up or slow down so that proper tension will be maintained.

Unit B, which is a rotating capstan and accumulator, has the frame thereof connected to the shaft 10 via belt 92 as was noted before. The speed of rotation of this is on a one-to-one basis with the rotation of the flyer 122, so as not to introduce any twist into the product. As was previously noted, the capstan 76 is rotated and this is rotated via a mechanical connection to the shaft 10 through a speed variation device 99 the output of which may be changed by a stepper motor 146, in effect, it may be desired to change the lay of the cable, and this is most easily done by providing a potentiometer 147 which would be on an operation console and allow the operator to dial in proper lay in inches by changing the speed of the capstan 76, the output of the potentiometer being fed to a control amplifier 150 that controls motor 146. In order to further control the lay and insure that the proper number of twists per revolution of the frame 78 is being achieved, the operation is monitored by a tachometer generator 140 and is effectively coupled to the timing shaft 10 and of course the motor 11, and a tachometer generator 110 is coupled to the capstan 76 and indicates its revolutions. These two tachometer generators are connected in a bucking relationship and the outputs thereof is fed over a potentiometer 152 to the input of amplifier 150. Effectively, amplifier 150 will control the stepper motor 146 which in turn will change the differential 99 and vary the speed of rotation of the capstan 76 as is necessary to maintain proper lay of the cable.

The strands which are to be made in the cable are fed to the lay plate 70 are fed from a neutralizer unit A, and as is seen in FIG. 1, the rotation of each of the flyers 24 is in step with the revolutions of the accumulator frame 78 and the flyer 122 by virtue of being coupled via the common shaft 10, and as stated before, one turn of flyer 122 is equal to one turn of flyer 24 and one turn of the capstan frame 78. It is essential that each of the strands be properly controlled for tension before they pass into the lay plate, and to achieve this, there is provided on each strand a control system which consists essentially of a tension sensing device that may take a simple form of a weighted arm 60 with a transducer 27 that can be an LVDT device, together with means for measuring the actual wire line speed in the form of an encoder 35. As explained more completely in my co-pending application Ser. No. 137,978 filed Apr. 7, 1980, the rotation of the pay-off reels is controlled by a motor 40 that has attached thereto a DC tach 154 and a digital encoder 155. Essentially the main command signal is generated by the line speed encoder 35. In addition, the LVDT 27 generates a signal responsive to line tension and this signal which must be in digital form is fed to a rate multiplier 157, the output of which is fed to an up-down counter 159, which also has a command signal coming from the line speed encoder 35. The analog portion, however, of the line speed signal is fed into a summing and integrating amplifier 160, which also receives the analog input converted from the up-down counter 159. The output of integrating amplifier 160 is fed through a suitable current limiter 162, whose output in turn is modified by the output of tachometer generator 154 in the feed-back sense, then feeds and controls the power stage 164, which in effect, is a pulse width modulator that can finely control with output pulses, the speed of the motor 40. It will be understood that a similar situation exists at each of the strand outputs, only one strand output having been diagrammed for the sake of simplicity.

By utilizing this system, which is under very fine control, there is no back twist that is put into the strand which has to be taken out by any other operation. Tension is finely controlled, both before the twisting operation and thereafter, and effectively, the great advantage of the system is that it will operate at rather high speeds of at least 100 to 200 feet per minute. The tension on each strand is equal, and a fine cable product emerges.

I claim:

1. A cabling apparatus for twisting together a plurality of strands comprising a pay-off neutralizer for each strand, each neutralizer having a hollow shaft, a reel axially mounted relative to said shaft, a flyer rotatably mounted about said reel, each cable strand passing from said reel about the flyer and thence through said shaft to a twister, means rotating said flyer, said twister including an accumulator and capstan rotating in a frame, means rotating said frame, take-up means to package the cable, means rotating said take-up means, said means rotating said flyer, frame and said take-up means driving each of said elements in a one-to-one relationship.

2. A cabling apparatus as in claim 1 wherein the means rotating said flyer, frame and take-up is an elongate driven shaft.

3. A cabling apparatus as in claim 1 wherein tension of each strand is sensed at the output of each pay-off and first control means are provided to maintain substantially constant tension, and wherein the cable tension is sensed before the take-up, and second control means to maintain substantially constant cable tension.

* * * * *